US005622155A

United States Patent [19]

Ellwood et al.

[11] Patent Number: 5,622,155

[45] Date of Patent: Apr. 22, 1997

[54] FUEL INJECTED INTERNAL COMBUSTION ENGINE

[75] Inventors: Nicholas J. Ellwood, Doubleview; Raymond J. Hill, Warnbro, both of Australia

[73] Assignee: Orbital Engine Company (Australia) Pty. Limited, Western Australia, Australia

[21] Appl. No.: 525,660

[22] PCT Filed: Apr. 22, 1994

[86] PCT No.: PCT/AU94/00210

§ 371 Date: Sep. 29, 1995

§ 102(e) Date: Sep. 29, 1995

[87] PCT Pub. No.: WO94/25742

PCT Pub. Date: Nov. 10, 1994

[30] Foreign Application Priority Data

Apr. 29, 1993 [AU] Australia ..... PL8534

[51] Int. Cl.[6] ..... F02M 51/00

[52] U.S. Cl. ..... 123/531

[58] Field of Search ..... 123/531, 305, 123/533, 456

[56] References Cited

U.S. PATENT DOCUMENTS

| | | | |
|---|---|---|---|
| 2,710,600 | 6/1955 | Nallinger | 123/533 |
| 4,006,719 | 2/1977 | Kanda et al. | 123/531 |
| 4,781,164 | 11/1988 | Seeber et al. | 123/533 |
| 5,036,824 | 8/1991 | Albertson et al. | 123/456 |
| 5,101,800 | 4/1992 | Schumann et al. | 123/531 |
| 5,129,381 | 7/1992 | Nakajima | 123/531 |
| 5,170,766 | 12/1992 | Hass et al. | 123/531 |
| 5,172,865 | 12/1992 | Takano et al. | 123/531 |
| 5,205,254 | 4/1993 | Ito et al. | 123/305 |
| 5,358,181 | 10/1994 | Tani et al. | 123/531 |
| 5,360,079 | 11/1994 | Ichikawa et al. | 123/531 |
| 5,449,120 | 9/1995 | Tani et al. | 123/531 |

FOREIGN PATENT DOCUMENTS

| | | |
|---|---|---|
| 4129834 | 3/1993 | Germany . |
| 572080 | 9/1945 | United Kingdom . |

OTHER PUBLICATIONS

Patent Abstracts of Japan, JP,A,1–19170; Jan. 23, 1989.

*Primary Examiner*—David A. Okonsky

*Attorney, Agent, or Firm*—Nikaido, Marmelstein, Murray & Oram LLP

[57] ABSTRACT

An internal combustion engine having a fuel injector (7) arranged for injecting fuel into a combustion chamber, the fuel injector (7) including a nozzle chamber (25) having a selectively openable nozzle (15) at one end to communicate the nozzle chamber (25) with the combustion chamber and including a fuel metering device (14) arranged to selectively deliver fuel to the nozzle chamber (25). There is also provided a gas chamber (10) adjacent the combustion chamber and in communication with the nozzle chamber (25). Preferrably, the gas chamber (10) is located within the cylinder head (1) adjacent the nozzle chamber (25).

17 Claims, 2 Drawing Sheets

FUEL INJECTED INTERNAL COMBUSTION ENGINE

Figure 1:
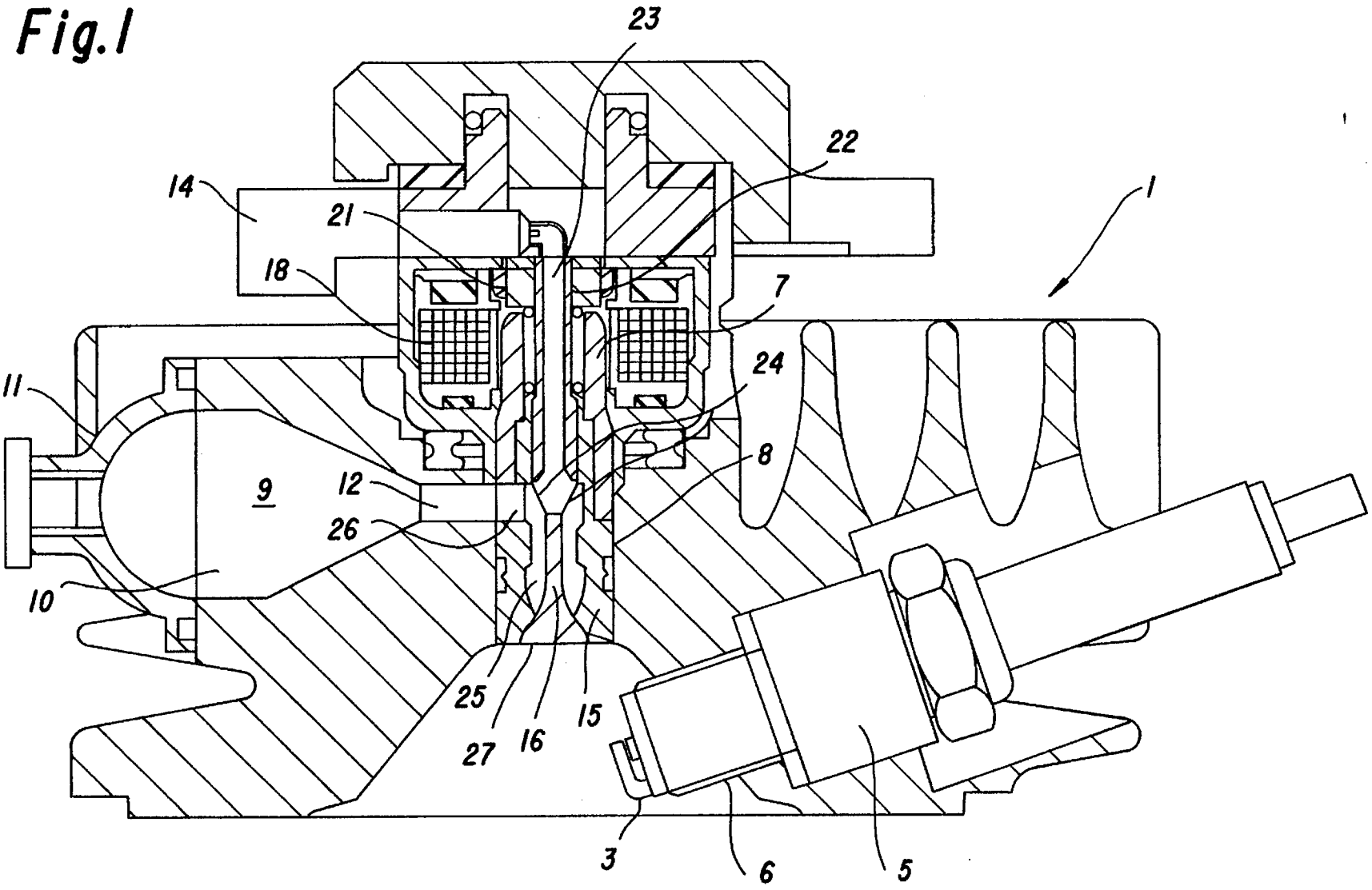

This invention relates to a fuel injected internal combustion engine and in particular to a direct injected internal combustion engine, that is, an engine wherein individual metered quantities of fuel are injected directly into the respective cylinder(s) of the engine. More particularly, the invention is directed to such engines wherein the fuel is injected entrained in a gas, preferably air.

Engines of the above type are known and typically incorporate a reservoir for the gas used in the injection process wherein the gas at an appropriate pressure is held and sequentially delivered to the respective injector(s) of the engine to carry out the injection process. In multi-cylinder engines of the above type, it has been suggested in prior patent applications to provide a plenum chamber in direct communication with each of the injector units as the source of compressed gas.

It has been proposed to take compressed gas from the cylinders of the engine for subsequent use as a supply of high pressure gas for effecting the injection of fuel into the engine combustion chambers. In two such prior proposals, as disclosed in U.S. Pat. No. 2,710,600 and GB Patent Application No. 2093113, coaxial fuel and air chambers are provided with the fuel being delivered to the fuel chamber and gas from a combustion chamber to the gas chamber. The gas is further compressed in this gas chamber to effect transfer of the gas to the fuel chamber and subsequent delivery of the fuel entrained in the gas to the combustion chamber. A more complex system of extracting high pressure gas from the combustion chamber for use in subsequent injection of fuel is disclosed in the Applicant's U.S. Pat. No. 4,781,164. The proposals disclosed in this US patent are relatively complex and in each instance supply the gas extracted from the combustion chamber to an external chamber or reservoir from which it is subsequently supplied to the air/fuel injectors.

Further, there is disclosed in Japanese Patent Application Publication 64-19170 an engine having individual systems for delivering fuel and compressed air independently to the combustion chamber of an engine. The respective locations of the air and fuel delivery points are arranged so that the air and fuel are mixed on entry to the combustion chamber. It is proposed that by injecting the air into the combustion chamber independently of the injection of the fuel, the timing of the commencement and conclusion of the delivery of the air can be independently varied in relation to the delivery of the fuel. The advantage of this independent delivery of the fuel and air to the combustion chamber is said to be that it provides unrestricted selection of the timing and duration of the supply of air so that the most beneficial effect is achieved in relation to the management of the combustion process.

It is the object of the present invention to provide an internal combustion engine having a fuel injection system incorporating a compressed gas supply which is constructed and arranged to not substantially increase the external physical dimensions of the engine and which will contribute to the effective performance of the injection system and consequently of the engine.

With this object in view, there is provided an internal combustion engine having at least one combustion chamber, and respective fuel injector means arranged to deliver fuel to each said combustion chamber, each fuel injector means including a nozzle chamber having a selectively openable nozzle operable to communicate the nozzle chamber with the combustion chamber, fuel metering means to meter fuel for delivery from the nozzle chamber to the combustion chamber, and gas chamber means arranged adjacent said combustion chamber laterally spaced from said nozzle chamber and in communication therewith to supply gas to the nozzle chamber, whereby the fuel is delivered from the nozzle chamber to the combustion chamber entrained in the gas.

Preferably, the gas chamber means and/or the nozzle chamber are located within a cylinder head of the engine, and when both are so located, the gas chamber means and the nozzle chamber are preferably located adjacent one another. Normally the gas chamber is in direct communication with the nozzle chamber. Alternatively the gas chamber means may be elsewhere located in the wall of the combustion chamber.

Conveniently, in the operation of the above engine, the fuel injector means is arranged whereby during each combustion cycle of operation, the nozzle is opened for a period of time after completion of the fuel delivery from the nozzle chamber to the combustion chamber. This permits gas from the combustion chamber to pass through the nozzle chamber to raise the gas pressure in the gas chamber means to a level sufficient to effect the fuel delivery during the next engine cycle. Preferably, the nozzle is held open for a period after and continuous with the injection of the fuel into the combustion chamber to allow gas to pass into the nozzle chamber to effect said rise of the gas pressure in the gas chamber means.

Conveniently, in a multi-cylinder engine, a single gas chamber means can be provided communicating with the nozzle chamber associated with the combustion chamber of each cylinder. The single gas chamber means can be in the form of a series of individual intercommunicating gas chamber means, conveniently one for each combustion chamber. In this arrangement, it is not necessary for each injector nozzle associated with each combustion chamber to individually be maintained open after completion of fuel delivery to a respective combustion chamber for an extended period to provide a gas supply to maintain the required gas pressure. The gas supplied from one or two combustion chambers can be sufficient to provide the required quantity and pressure of gas to all of the individual gas chamber means of a multi-cylinder engine. Further, where only one or some combustion chambers are employed to supply the gas to the gas chamber means of a multi-cylinder engine, that duty may be rotated between respective combustion chambers of the engine in a selected sequence. It should however be noted that although it is convenient, red cost and energy saving, to supply the gas to all of the gas chamber means from one or more cylinders of an engine, the gas can as an alternative be supplied from an external source, including an engine driven compressor or independent source.

It has been found that the overall height or width of the engine, depending upon the disposition thereof, can be reduced by incorporating the gas chamber means into the cylinder head or wall of the combustion chamber adjacent the fuel injector means when compared with prior constructions wherein the fuel injector means and the gas chamber means are typically arranged in a back to back or axially aligned relation with respect to the nozzle chamber. In addition, when the gas chamber means of the present invention is located within the cylinder head or otherwise close to the combustion chamber, any gas therein is generally at a higher temperature than it would be in prior constructions.

The higher temperature of the gas can be of assistance in the control of deposits in the gas chamber means and nozzle chamber, and in the stability of operation of the engine, particularly during engine idle operation. The improved stability at idle is believed to arise from "fuel hang-up" in the fuel injector means and/or the gas chamber means being reduced as a result of the higher temperature of the gas in the nozzle chamber and the gas chamber means and the consequential increased vaporisation of the fuel. Also, the proposed construction enables the gas path from the gas chamber means to the nozzle chamber, to be reduced in length.

The invention will now be described in more detail with reference to the accompanying drawings of two practical arrangements of an engine cylinder head incorporating the fuel injector means and gas chamber means as proposed herein.

Figure 2:
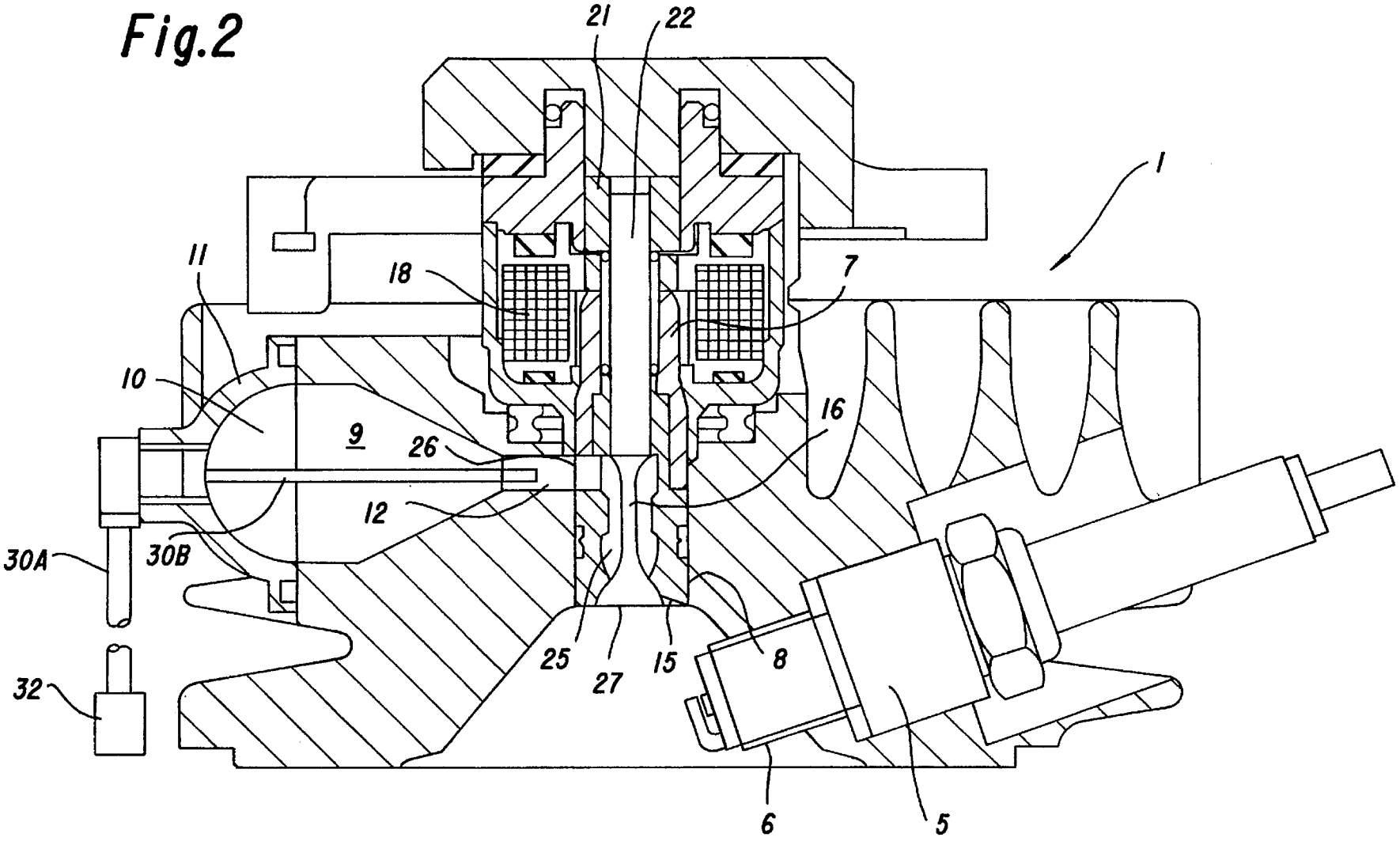

In the drawings,

FIG. 1 is a cross-sectional view of a cylinder head incorporating a fuel injector means and gas chamber means; and FIG. 2 is a similar cross-sectional view of an alternative construction therefor.

Referring now to FIG. 1, the engine cylinder head 1 is suitable for a conventional two stroke cycle engine. Further, the cross-section as shown can be considered as representing a single cylinder of a multi-cylinder engine or a single cylinder engine.

A conventional spark plug 5 is removably screwed into a suitably located thread passage 6 to project into a combustion chamber 3. A two fluid fuel injector 7 of known construction is located in a bore 8 in the cylinder head 1 to project into the combustion chamber 3 in a known manner. A gas chamber 10 is partly formed by a cavity 9 formed within the cylinder head 1 and partly in a detachable cover plate 11. The gas chamber 10 is in continuous communication with the fuel injector 7 by way of a passage 12.

The fuel injector 7 includes a nozzle 15 received in the bore 8 in the cylinder head 1 and a popper valve 16 controlled by a solenoid unit 18 having an armature 21 attached to a stem 22 of the valve 16. The solenoid 18 is cyclically energised in the known manner to open and close the valve 16 for the delivery of fuel entrained in air to the combustion chamber 3. A fuel metering unit 14 cyclically delivers metered quantities of fuel into an axial passage 23 within the stem 22 which passes via lateral passages 24 in the stem 22 into an annular cavity 25 surrounding a lower end of the valve 16 which is in direct communication with an upstream side of a valve head 27 of the valve 16. Further information in regard to the fuel injector 7 is not provided as it is a well known construction, one example being disclosed in the Applicant's U.S. Pat. No. 4,934,329.

The nozzle 15 of the fuel injector 7, has a laterally disposed aperture 26 located to provide communication between the passage 12 and the annular cavity 25 about the exterior of the lower end of the valve 16. It is thus seen that there is a continuous free communication between the gas chamber in the cylinder head 1 and the annular cavity 25 in the fuel injector 7.

In the operation of an engine using the arrangement as above described, it is to be understood that the delivery of a metered quantity of fuel from the metering unit 14 into the axial passage 23 within the valve stem 22, is a separate operation from the opening of the valve 16 for the delivery of fuel entrained in a charge of gas from the gas chamber 10 through the nozzle 15 to the engine combustion chamber 3. Assuming a starting position wherein the gas chamber 10 is charged with gas previously received from the engine combustion chamber 3 and a piston (not shown) of an associated cylinder (not shown) corresponding with the combustion chamber 3 is moving upwardly on a compression stroke of the engine, and a metered quantity of fuel has been delivered by the metering unit 14 into the axial passage 23 within the valve stem 22 of the fuel injector 7, then upon opening of the valve 16 at a point in the compression stroke when the cylinder pressure is substantially below the pressure of the gas in the gas chamber 10, the metered quantity of fuel will be discharged through the nozzle 15 into the combustion chamber 3 entrained in gas which will flow from the gas chamber 10 through the passages 12 and 26 into the fuel injector 7 and hence, through the annular cavity 25 and out through the open nozzle 15.

After a relatively short interval of time, all of the metered quantity of fuel will have been discharged through the nozzle 15 into the combustion chamber 3, and the continuing upward movement of the piston in the cylinder will provide a resultant rising pressure in the combustion chamber 3. At this point in time, the nozzle 15 is still maintained open to facilitate the subsequent re-pressurisation of the gas chamber 10. In this regard, a condition will be reached where the pressure in the combustion chamber 3 is greater than that in the gas chamber 10 and there will be a reverse flow of gas from the combustion chamber 3, through the open nozzle 15 and passages 26 and 12, into the gas chamber 10 to replace the gas discharged during the previous delivery of the fuel, and to also raise the pressure of the gas in the gas chamber 10 to a level substantially above the pressure in the combustion chamber 3 at the time of initial opening of the nozzle 15, to effect subsequent delivery of the fuel to the combustion chamber 3. The nozzle 15 is then closed to retain the gas in the gas chamber 10 which is then in condition to effect delivery of fuel to the combustion chamber 3 during the next engine cycle.

In the construction shown in FIG. 1, the cover plate 11 provides access to the interior of the cavity 9 for machining or other finishing treatment of the internal surface of the cavity 9. The cover plate 11 may also be used in a modified form to provide communication between the gas chambers 10 of two or more cylinders of a multi-cylinder engine where gas is supplied from any number of the engine cylinders or from an external source. The cover plate 11 may also enable communication between the individual gas chambers 10 of a multi-cylinder engine with a single plenum chamber wherein the source of pressurised gas thereof may be the engine combustion chamber(s), an engine driven compressor, or an external source. The variations can be used where the cavity 9 is formed in the cylinder head or the cylinder wall.

Also, the shape of the cavity 9 as shown in FIG. 1 which tapers towards the passage 12 promotes the flow of any fuel which may enter the gas chamber 10 towards the passage 12 when the axis of the gas chamber 10 is vertical and the passage 12 lower than the gas chamber 10. Further, the generally hemispherical shape of the remainder of the cavity 9 provides a minimum surface area to volume ratio and hence contributes to reduced fuel hang-up.

FIG. 2 shows a modified version of the fuel injection system as shown in FIG. 1 wherein the principal differences reside in the location of the fuel metering device that delivers the metered quantity of fuel to the annular cavity 25 and the consequential alterations to the construction of the two fluid fuel injector 7.

In the embodiment shown in FIG. 2, the fuel is delivered by the metering device 32 through the fuel line 30A and needle 30B into the throat of the passage 12 and hence through the aperture 26 and hence into the annular cavity 25 about the exterior of the lower end of the valve 16. It will be appreciated that when the valve head 27 is in the open position gas will flow from the chamber 10 through the passages 12 and 26 to thereby entrain the fuel therein and in the annular cavity 25 to deliver same through the open injector nozzle 15. The length and direction of the needle 30B can be varied or adjustable to achieve the best operational position thereof relative to the gas chamber 10 and the passage 12. Also, the needle 30B can extend through the passages 12 and 26 to deliver the fuel directly into the annular cavity 25. Further, the needle 30B can extend into the cavity 25 and can be configured at the end thereof so as to direct fuel towards the valve head 27.

It will be noted that although the external configuration of the upper portion of the valve stem 22 is the same as in FIG. 1, the passage 23 through the stem is omitted to provide a solid stem as seen FIG. 2. In this embodiment, the fuel does not pass down through the center of the stem 22 but is delivered directly into the cavity 25 through the aperture 26 via the needle 30B.

This construction as shown in FIG. 2 reduces the length of the flow path of the fuel from the metering location to the injector nozzle 15 and hence reduces fuel hang-up and the adverse effect thereof on the control of the actual quantity of fuel delivered. The length of the flow path of gas from the gas chamber 10 is also reduced, and the solenoid unit 18 has reduced exposure to the hot gases entering the fuel injector 7 resulting in the operating temperature of the solenoid unit 18 being lower than would arise in prior known constructions such as those involving a "piggy-back" or axially aligned arrangement of the gas chamber and fuel injector as hereinbefore described. The resistance of the coil of the solenoid unit 18 increases with increase in temperature which is of course undesirable as it increases the current draw of the solenoid unit 18.

Although not shown in FIG. 1 or FIG. 2, appropriate guide projections may be provided on the external surface of the lower portion of the popper valve 16 which slidably engage the adjacent inner concentric surface of the nozzle 15 to thereby assist in maintaining the valve head 27 concentric with the valve seat of the nozzle 15. This construction is well known and commonly used in a wide range of known injector constructions, one example being disclosed in the Applicant's U.S. Pat. No. 4,759,335.

The fuel may be provided to the needle 30B by any known fuel metering device, but preferably a device insensitive to pressure such as a positive displacement pump, and one form of fuel metering device particularly suitable for use in this environment is that disclosed in the applicants prior copending International Patent Application No. PCT/AU92/00561, or International Patent Application No. WO 93/00502.

The above described constructions wherein the gas chamber 10 is incorporated in the cylinder head 1, avoid the necessity of providing an independent source of compressed gas for delivering fuel to the engine such as a compressor, thereby substantially reducing the overall manufacturing costs of the fuel injection system. Further, it has been found that the reverse flow of high temperature gases from the combustion chamber 3 through the nozzle 15 of the fuel injector 7 into the gas chamber 10 has the effect of maintaining the insides of the nozzle 15 and the gas chamber 10 substantially free of deposits of partially combusted fuel and consequently leads to a more efficient operation of the fuel injector 7 over extended periods. The high temperature in the gas chamber 10 assists in the vapourisation of the fuel and reduces fuel hang-up on the inner surfaces of the nozzle 15 and the surfaces of the valve 16.

The incorporation of the gas chamber 10 adjacent the combustion chamber 3, such as in the cylinder head 1 or wall of the combustion chamber 3, also reduces the overall physical size of the injector system. Further, as a result of the high temperature in the walls of the gas chamber 10, the build-up of deposits on the internal surfaces of the gas chamber 10 and in the nozzle 15 are typically reduced.

Even if the high pressure gas is supplied to the gas chamber 10 by a compressor, in preference to the combustion chamber 3, the above advantages are still achieved as a result of the high temperature in the walls of the gas chamber 10.

Further, it is to be understood that although the cylinder head 1 illustrated in the drawing is for a two stroke cycle engine, the invention is equally applicable to an engine operating on the four Stroke cycle. Also, it is to be understood that the gas can be air or any other gas and may contribute and assist in the overall combustion process as air does. Also, the fuel may be in a liquid vapour or gaseous form.

We claim:

1. An internal combustion engine having at least one combustion chamber, respective fuel injector means arranged to deliver fuel to each said combustion chamber, each fuel injector means including a nozzle chamber having a selectively openable nozzle operable to communicate the nozzle chamber with the combustion chamber, fuel metering means to meter fuel for delivery from the nozzle chamber to the combustion chamber, and gas chamber means arranged adjacent said combustion chamber laterally spaced from said nozzle chamber and in communication therewith to supply gas to the nozzle chamber, whereby the fuel is delivered from the nozzle chamber to the combustion chamber entrained in the gas.

2. An internal combustion engine as claimed in claim 1 wherein said fuel injector means is mounted in a wall of the combustion chamber with the nozzle arranged to inject fuel directly into said combustion chamber.

3. An internal combustion engine as claimed in claim 1 or 2 wherein said gas chamber means is located in a wall of the combustion chamber.

4. An internal combustion engine as claimed in claim 1 or 2 wherein said gas chamber means is located in an engine cylinder head defining part of the combustion chamber.

5. An internal combustion engine as claimed in claim 1 wherein the nozzle chamber is located in an engine cylinder head defining part of the combustion chamber.

6. An internal combustion engine as claimed in claim 1 wherein the gas chamber means is in continuous communication with the nozzle chamber.

7. An internal combustion engine as claimed in claim 1 wherein the fuel injector means is adapted to maintain the nozzle thereof open for a selected period between successive deliveries of fuel to the combustion chamber to permit gas to pass into the gas chamber means from the combustion chamber through the nozzle and the nozzle chamber to re-establish a pressure in the gas chamber means above a preselected level.

8. An internal combustion engine as claimed in claim 7 wherein said fuel injector means is adapted to maintain the nozzle chamber in communication with the combustion chamber for a period which allows sufficient accumulation of gas in the chamber means to effect successive delivery of the fuel to the combustion chamber and the passage of gas into the nozzle chamber.

9. An internal combustion engine as claimed in claim 1 wherein a fuel metering means is arranged to deliver fuel to or directly into the nozzle chamber through a duct.

10. An internal combustion engine as claimed in claim 9 wherein the duct extends through the gas chamber means.

11. An internal combustion engine as claimed in claim 1 wherein the fuel metering means is arranged to deliver the fuel into the gas chamber means.

12. An internal combustion engine as claimed in claim 1 wherein the fuel metering means is arranged to deliver the fuel into a passage communicating the gas chamber means with the nozzle chamber.

13. An internal combustion engine claimed in claim 1 wherein the fuel injector means includes a valve stem, and wherein the fuel metering means is arranged to deliver fuel to the nozzle chamber through a passage extending longitudinally through the valve stem.

14. An internal combustion engine as claimed in claim 1 being a multi-cylinder engine, each cylinder having a respective combustion chamber, fuel injector means and gas chamber means, said gas chamber means of two or more cylinders being in communication for the free passage of gas therebetween.

15. An internal combustion engine as claimed in claim 14 wherein the fuel injector means of at least one of those cylinders that have the gas chamber means thereof in communication is adapted to maintain the nozzle thereof open for a selected period between successive deliveries of fuel to the combustion chamber of the cylinder to permit gas to pass into the gas chamber means thereof from the combustion chamber through the nozzle into the nozzle chamber and gas chamber to re-establish a pressure in each of the communicating gas chamber means above a preselected level.

16. An internal combustion engine according to claim 1 claims wherein the gas chamber means includes a tapered portion tapering towards the nozzle chamber.

17. An internal combustion engine according to claim 1 wherein the gas chamber means includes a hemispherical portion facing the nozzle chamber.

* * * * *